US007922598B1

(12) United States Patent
Karpyak et al.

(10) Patent No.: US 7,922,598 B1
(45) **Date of Patent: *Apr. 12, 2011**

(54) GOLFER ALIGNMENT SYSTEM

(76) Inventors: Steven D. Karpyak, Richardson, TX (US); Dale E. Karpyak, Watford City, ND (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/843,923

(22) Filed: Jul. 27, 2010

Related U.S. Application Data

(63) Continuation of application No. 11/752,097, filed on May 22, 2007, now Pat. No. 7,775,900.

(51) Int. Cl.
*A63B 69/36* (2006.01)

(52) U.S. Cl. ..... 473/272; 473/270

(58) Field of Classification Search ..... 473/266, 473/207, 272

See application file for complete search history.

(56) References Cited

U.S. PATENT DOCUMENTS

| | | | | |
|---|---|---|---|---|
| 4,322,084 | A * | 3/1982 | Reece et al. | 473/273 |
| 5,246,234 | A * | 9/1993 | Zambelli | 473/272 |
| 5,350,177 | A * | 9/1994 | Furbush, Jr. | 473/218 |
| 5,411,266 | A * | 5/1995 | Guthry | 473/218 |
| 5,464,220 | A * | 11/1995 | Hansen et al. | 473/218 |
| 6,723,003 | B1 * | 4/2004 | Harrell | 473/270 |
| 7,261,640 | B1 * | 8/2007 | Baggott | 473/270 |
| 7,431,661 | B1 * | 10/2008 | Cailey | 473/257 |
| 7,775,900 | B1 * | 8/2010 | Karpyak et al. | 473/272 |
| 2003/0220151 | A1 * | 11/2003 | Bainter | 473/270 |
| 2008/0015046 | A1 * | 1/2008 | Baggott | 473/272 |

* cited by examiner

*Primary Examiner* — Raleigh W. Chiu
(74) *Attorney, Agent, or Firm* — Neustel Law Offices

(57) ABSTRACT

A golfer alignment system for efficiently assisting a golfer in aligning their golf club and body properly while hitting a golf ball. The golfer alignment system generally includes a first alignment member comprised of an elongated configuration, a second alignment member comprised of an elongated configuration, wherein the second alignment member is substantially parallel to the first alignment member and at least one diagonal member attached between the first alignment member and the second alignment member. The diagonal member is attached in an oblique configuration with respect to the first alignment member and the second alignment member.

19 Claims, 12 Drawing Sheets

GOLFER ALIGNMENT SYSTEM

CROSS REFERENCE TO RELATED APPLICATIONS

I hereby claim benefit under Title 35, United States Code, Section 120 of U.S. patent application Ser. No. 11/752,097 filed May 22, 2007 now U.S. Pat. No. 7,775,900. This application is a continuation of the Ser. No. 11/752,097 application. The Ser. No. 11/752,097 application is currently pending. The Ser. No. 11/752,097 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to improvement of an individual's golf game and more specifically it relates to a golfer alignment system for efficiently assisting a golfer in aligning their golf club and body with a target while hitting a golf ball.

2. Description of the Related Art

Any discussion of the prior art throughout the specification should in no way be considered as an admission that such prior art is widely known or forms part of common general knowledge in the field.

Devices to improve an individual's golf game have been in use for years. The need to provide a device to improve an individual's golf game stems from the inherent difficulty of the game of golf. A couple of the difficulties associated with playing golf include properly aligning your stance and also properly aligning the head of the golf club with the golf ball. It can be difficult for an individual to properly align their feet and club with the exact direction of the target (i.e. hole, pin, etc.). The inherent difficulty in this stems from not only the fact that the target is generally a few hundred yards away, but the individual must also stand perpendicular to the target.

The devices currently known and utilized to help improve an individual's golf game generally include a straight member for the individual to position in front of their feet, wherein the straight member is also aligned with the individual's target. The member is supposed to help ensure that the individual maintains a perpendicular orientation with the target. However, these members generally require the individual to be able to visually identify a parallel orientation between the golf club aim and the individual's feet. This can be difficult for many people not familiar or not an expert at the game of golf. Because of the general lack of efficiency and practicality in the prior art there is the need for a new and improved golfer alignment system for efficiently assisting a golfer in aligning their golf club and body properly while hitting a golf ball.

BRIEF SUMMARY OF THE INVENTION

The general purpose of the present invention is to provide a golfer alignment system that has many of the advantages of the golf game improvement mechanisms mentioned heretofore. The invention generally relates to a golf game improvement mechanism which includes a first alignment member comprised of an elongated configuration, a second alignment member comprised of an elongated configuration, wherein the second alignment member is substantially parallel to the first alignment member and at least one diagonal member attached between the first alignment member and the second alignment member. The diagonal member is attached in an oblique configuration with respect to the first alignment member and the second alignment member.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a golfer alignment system for efficiently assisting a golfer in aligning their golf club and body properly while hitting a golf ball.

Another object is to provide a golfer alignment system that assists a golfer in visualizing a correct alignment between their feet, their golf club and the hole.

An additional object is to provide a golfer alignment system that assists a golfer in determining common alignment errors in their normal stance.

A further object is to provide a golfer alignment system that easily folds up for storage and for carrying to a practice range.

Another object is to provide a golfer alignment system that is adjustable to accommodate a wide array of characteristic stances and individuals.

Another object is to provide a golfer alignment system that is easy to utilize.

Another object is to provide a golfer alignment system that is lightweight.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
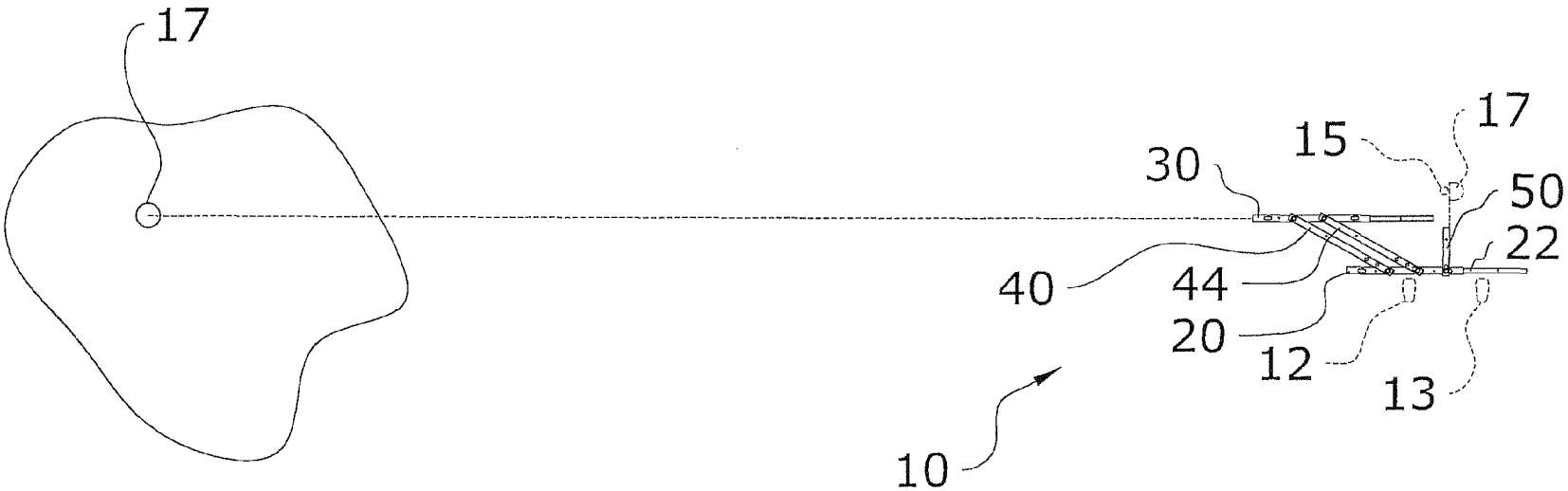
FIG. 1 is a top view illustrating the present invention in use.

Turning now descriptively to the drawings, in which similar reference characters denote similar elements throughout the several views, FIGS. 1 through 12 illustrate a golfer alignment system 10, which comprises a first alignment member 20 comprised of an elongated configuration, a second alignment member 30 comprised of an elongated configuration, wherein the second alignment member 30 is substantially parallel to the first alignment member 20 and at least one diagonal member attached between the first alignment member 20 and the second alignment member 30. The diagonal member is attached in an oblique configuration with respect to the first alignment member 20 and the second alignment member 30.

B. Alignment Members

The present invention includes the first alignment member 20 and the second alignment member 30 to assist the individual in aligning their feet 12, 13 and club head 17 with the desired target 19 as illustrated in FIGS. 1 through 9. The first alignment member 20 is further preferably oriented parallel with the second alignment member 30, wherein the individual preferably aligns their left foot 12 and right foot 13 with an outer edge of the first alignment member 20. The second alignment member 30 is preferably aligned with the associated target 19 (i.e. hole, pin, point in the fairway, etc.) where the individual is aiming.

Figure 12:
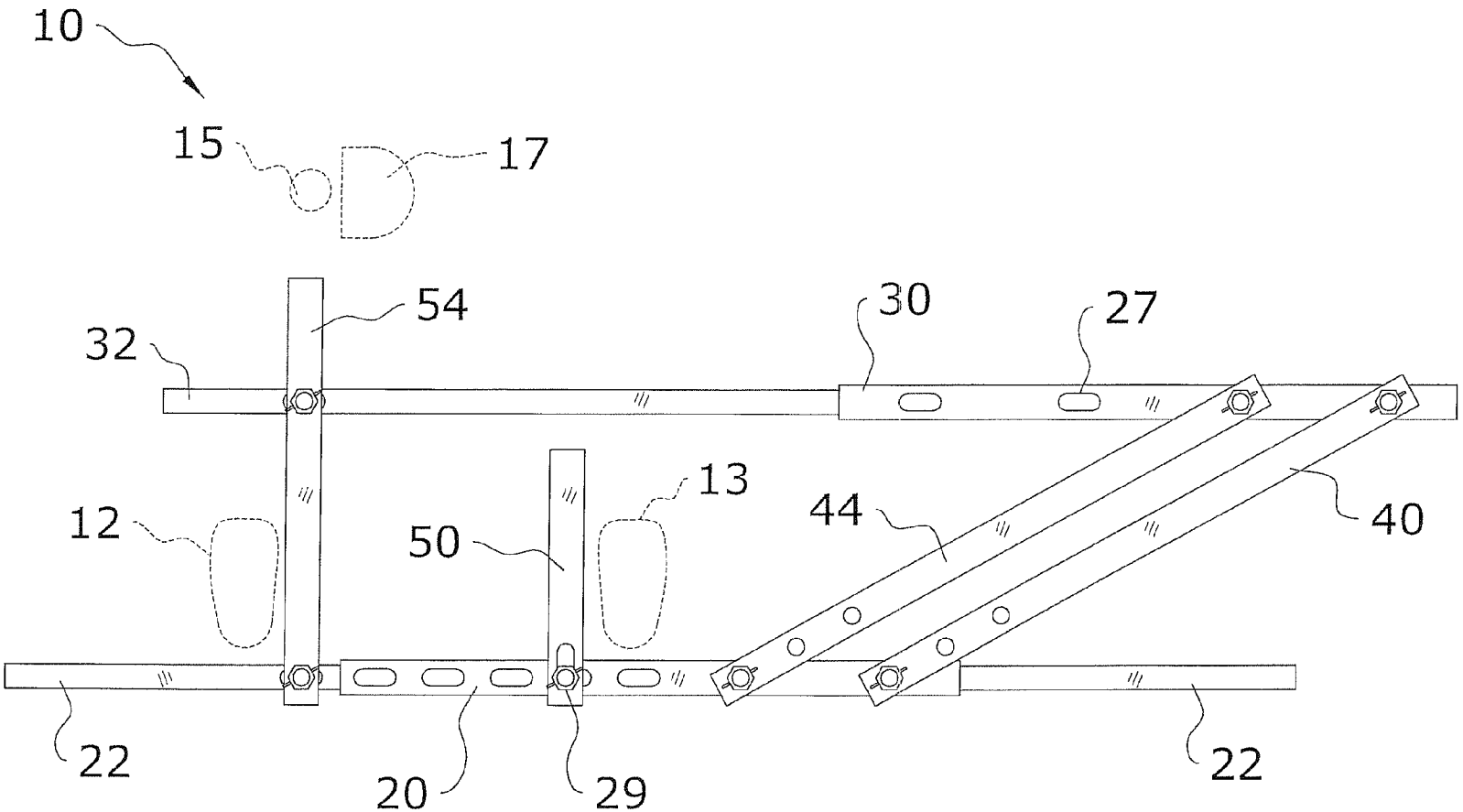
FIG. 12 is a top view of the present invention illustrating an alternate positioning of a golfer's stance with the present invention.

It is also appreciated that the individual may align their left foot 12 and right foot 13 with an inner edge of the first alignment member 20 as illustrated in FIG. 12. The user may also utilize an alternate alignment member 54 to align with the golf ball 15, such as but not limited to when positioning their left foot 12 and right foot 13 upon the inner edge of the first alignment member 20 as shown in FIG. 12.

Figure 8:
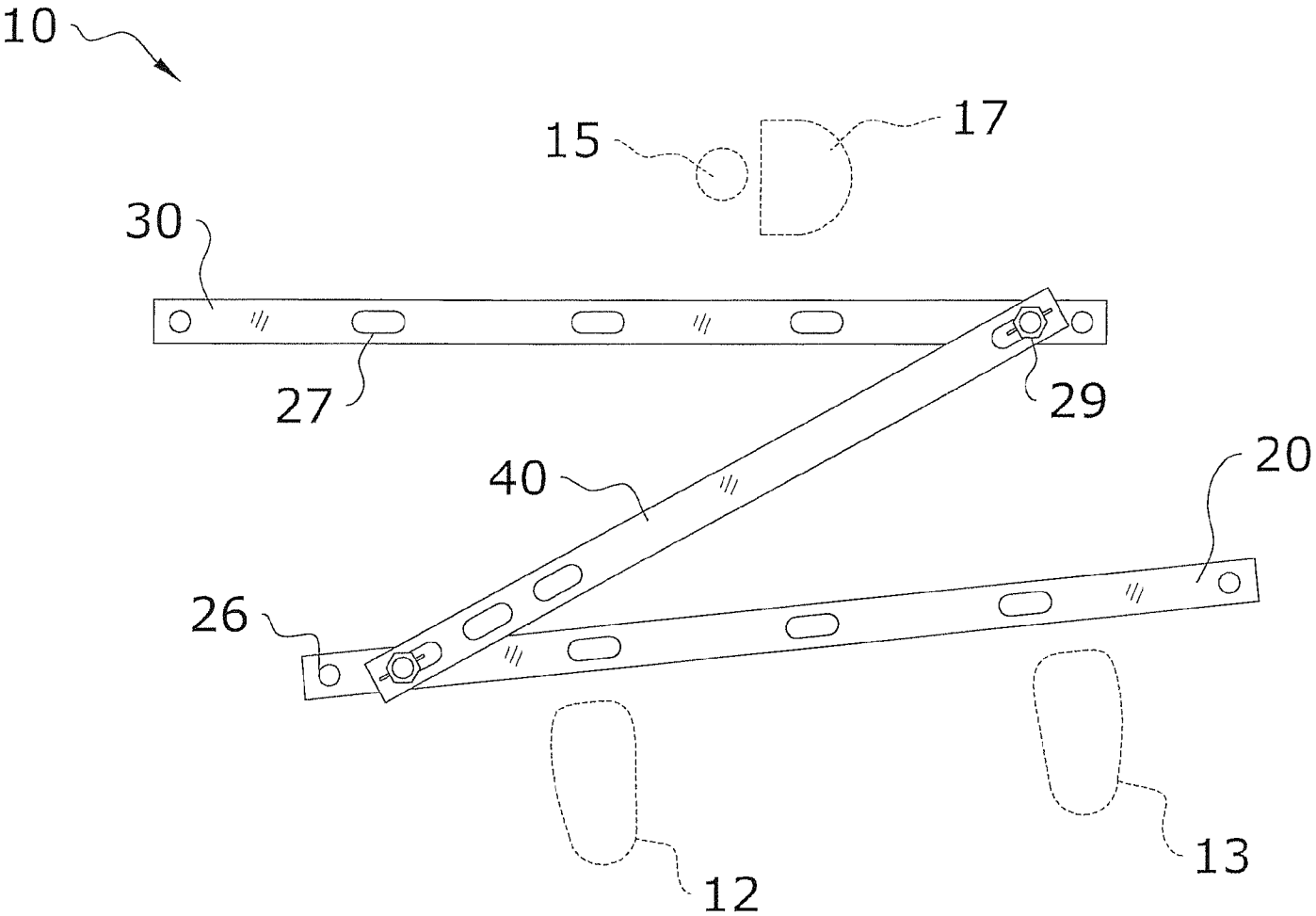
FIG. 8 is a top view of an alternative configuration of the present invention with the first alignment member positioned to accommodate an open stance.
Figure 9:
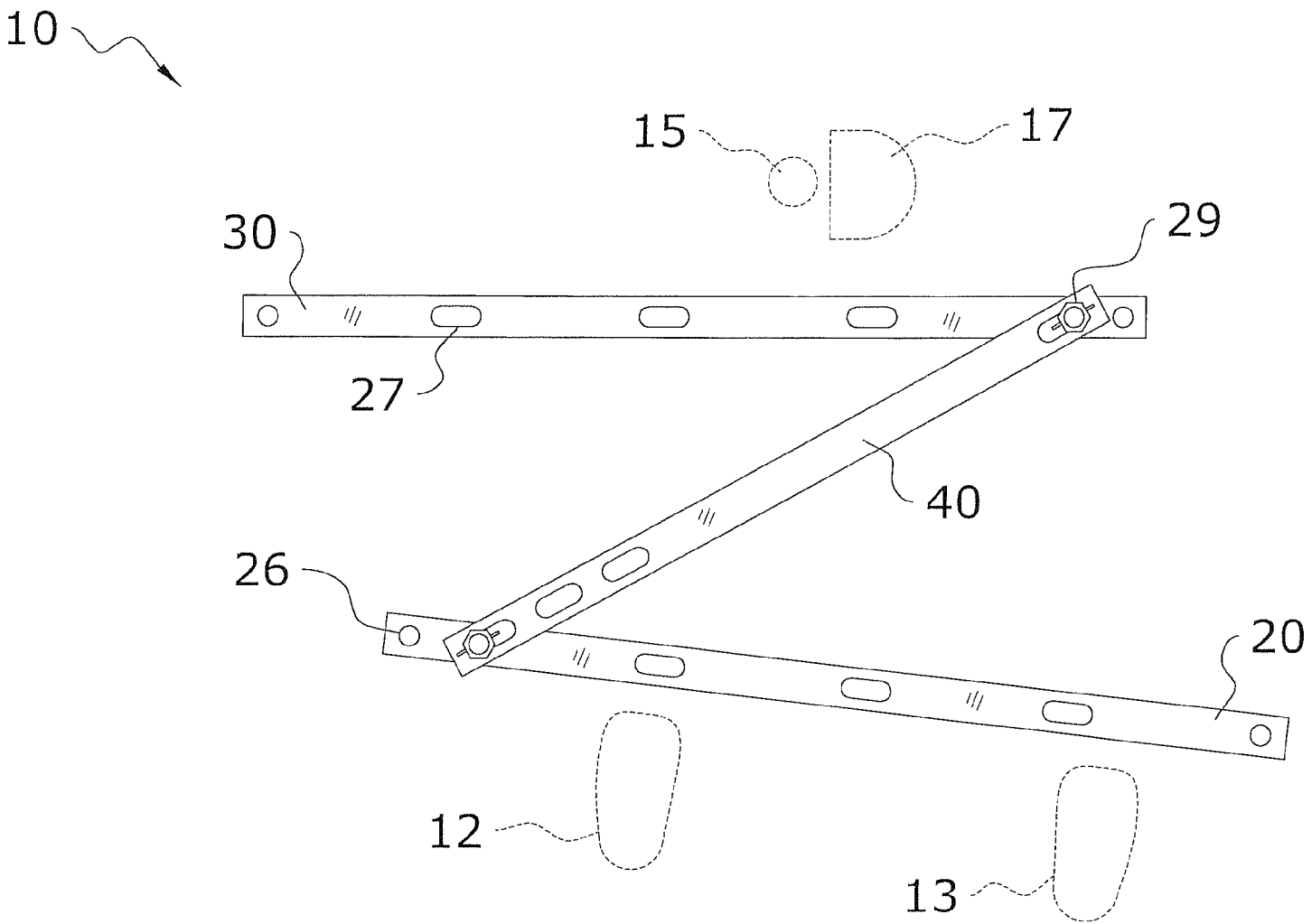
FIG. 9 is a top view of the alternative configuration of the present invention with the first alignment member positioned to accommodate a closed stance.

It is appreciated that in certain circumstances and/or with various stances (i.e. positioning of the left foot 12 and the right foot 13) utilized by golfers, the first alignment member 20 may be desired to be adjusted in an alternate orientation rather than parallel with the second alignment member 30. The first alignment member 20 may be angled slightly away from (i.e. closed stance) the second alignment member 30 as illustrated in FIG. 9 or slightly towards (i.e. open stance) the second alignment member 30 as illustrated in FIG. 8.

The first alignment member 20 and the second alignment member 30 are preferably comprised of substantially similar configurations as shown in FIGS. 1 through 9. The first alignment member 20 and the second alignment member 30 are comprised of elongated configurations. The first alignment member 20 and the second alignment member 30 may be comprised of various materials such as but not limited to plastic, metal or wood.

Figure 2:
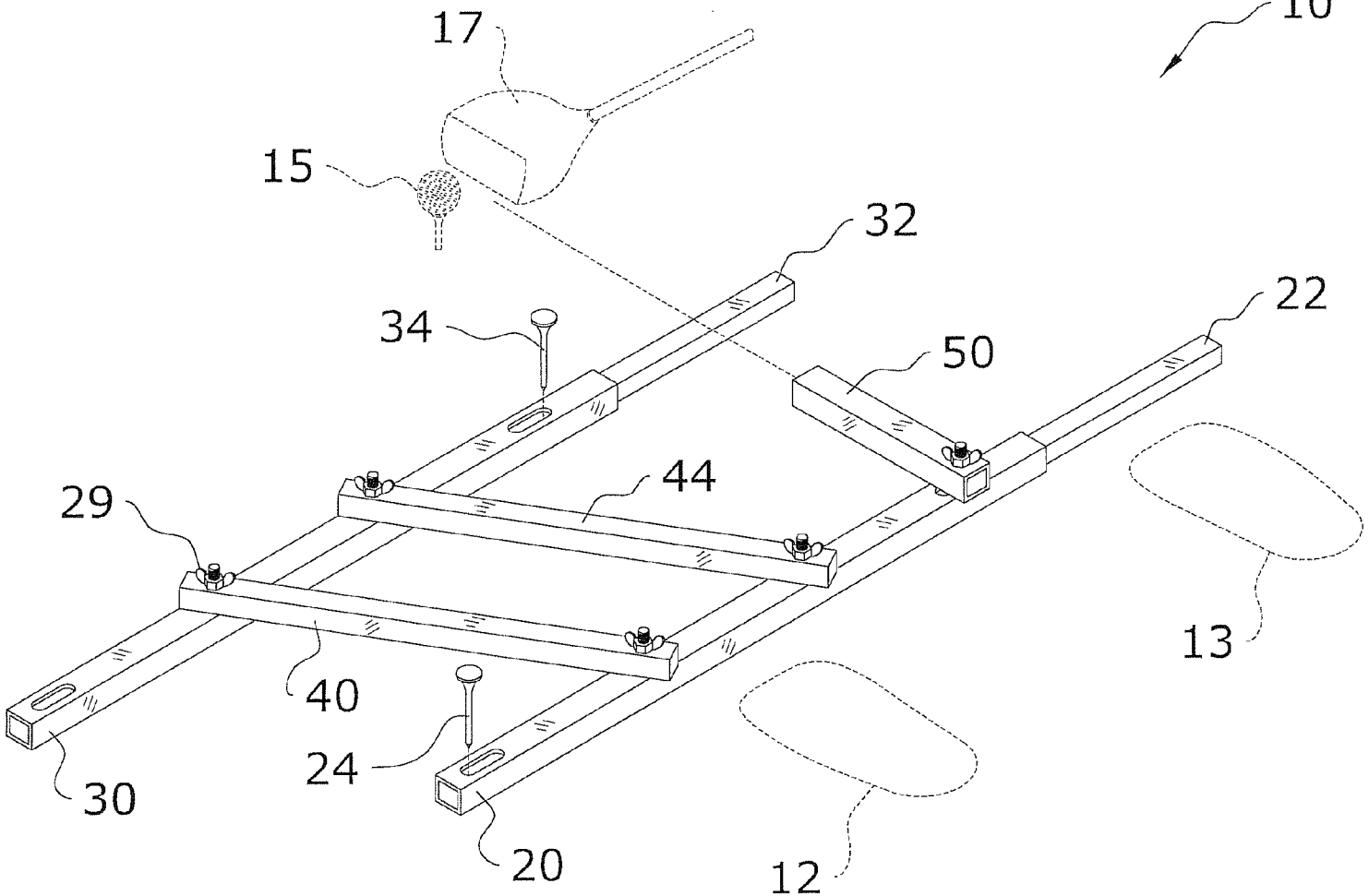
FIG. 2 is an upper perspective view of the present invention.
Figure 3:
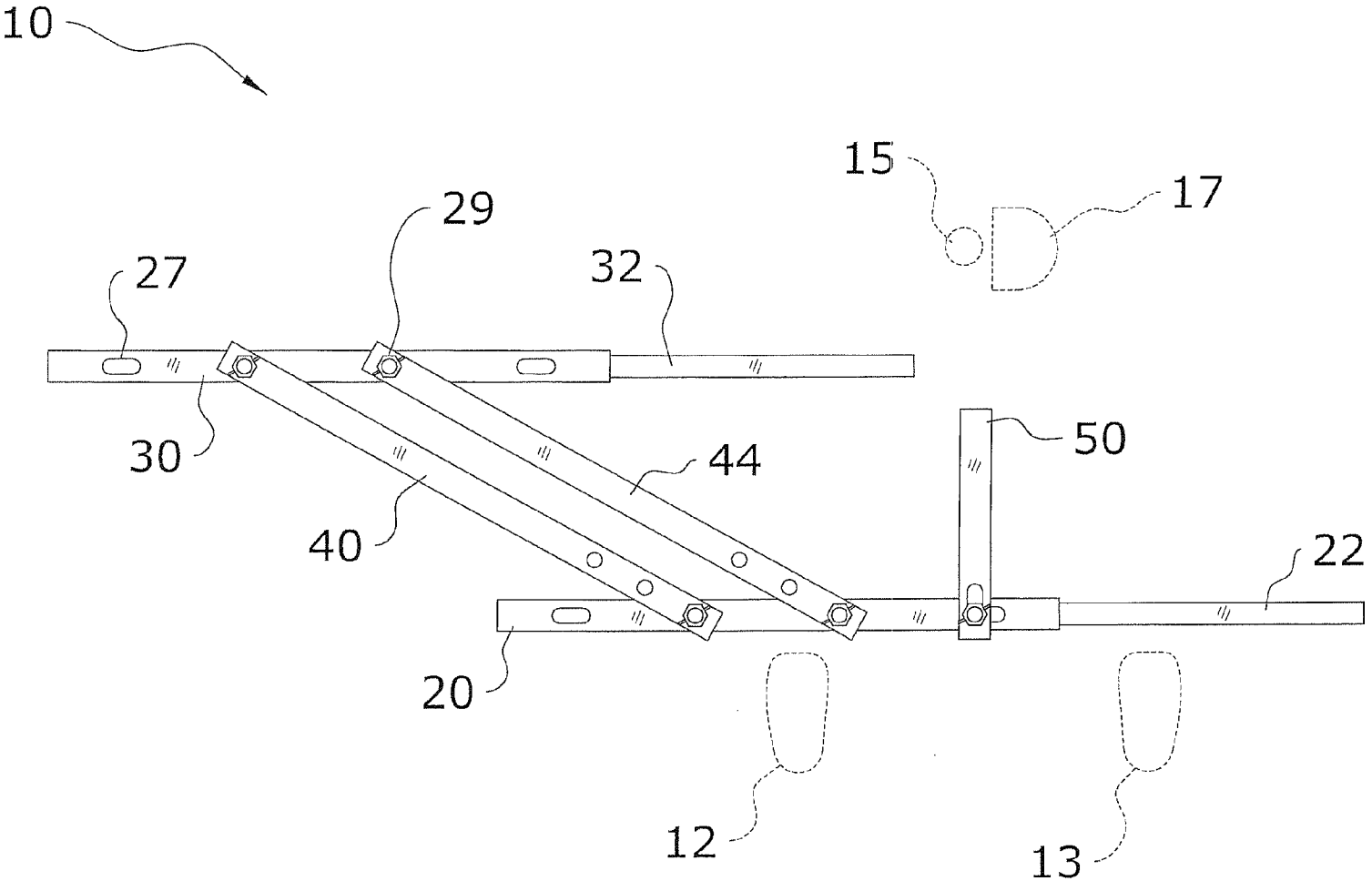
FIG. 3 is a top view of the present invention.
Figure 4:
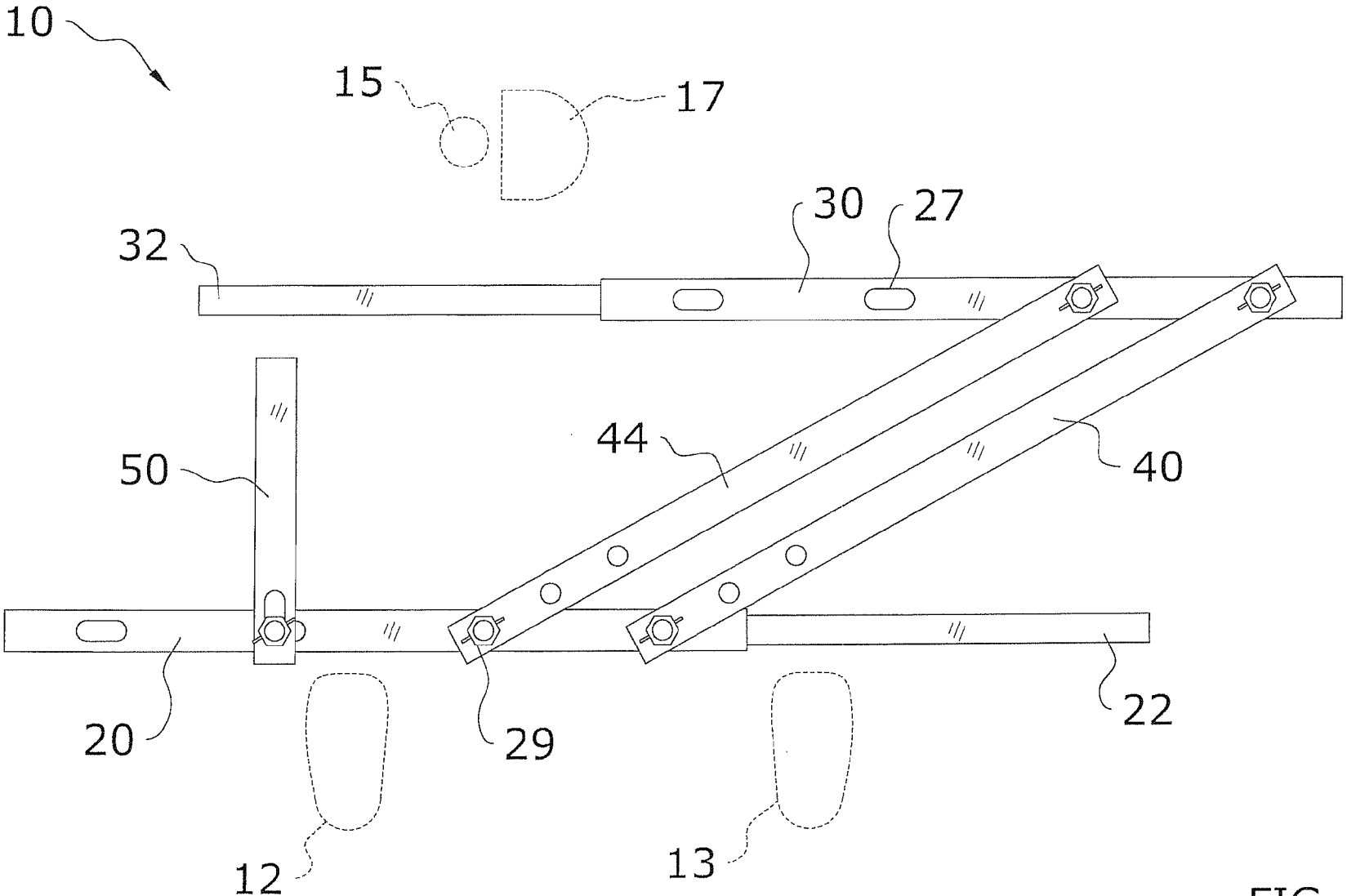
FIG. 4 is a top view of the present invention in a Z-shaped configuration.

The first alignment member 20 preferably includes a first extension member 22 as illustrated in FIGS. 2 through 4. The second alignment member 30 also preferably includes a second extension member 32 as illustrated in FIGS. 2 through 4. The first extension member 22 and the second extension member 32 preferably slidably adjust within the first alignment member 20 and the second alignment member 30 respectively. The first extension member 22 and the second extension member 32 serve to allow the individual to more easily visualize the orientation of the first alignment member 20 and the second alignment member 30 (i.e. parallel, angled towards the open stance, angled towards the closed stance, etc.).

The first extension member 22 and the second extension member 32 are also preferably secured about the first alignment member 20 and the second alignment member 30 via a fastener 29 as illustrated in FIGS. 2 through 4. The fastener 29 is preferably comprised of a configuration in which to allow the individual to easily adjust the fasteners 29 and thus first extension member 22 and/or second extension member 32 when out on the golf course. Some possible configurations for the fasteners 29 include a hinge, a wing nut, a snap member and a bolt. The fasteners 29 further preferably extend through a plurality of openings, herein referred to as apertures 26 and/or slots 27 in the first alignment member 20 and the second alignment member 30 to engage the first extension member 22 and the second extension member 32.

It is appreciated that the first alignment member 20 and the second alignment include a plurality of slots 27 and/or apertures 26 to allow for adjustability of the extension members, diagonal members 40, 44 and cross members 60, 64. The apertures 26 and slots 27 are further illustrated in FIGS. 1 through 9. It is appreciated that the present invention may include various amounts of apertures 26 and/or slots 27 rather than what is illustrated in FIGS. 1 through 9.

Figure 10:
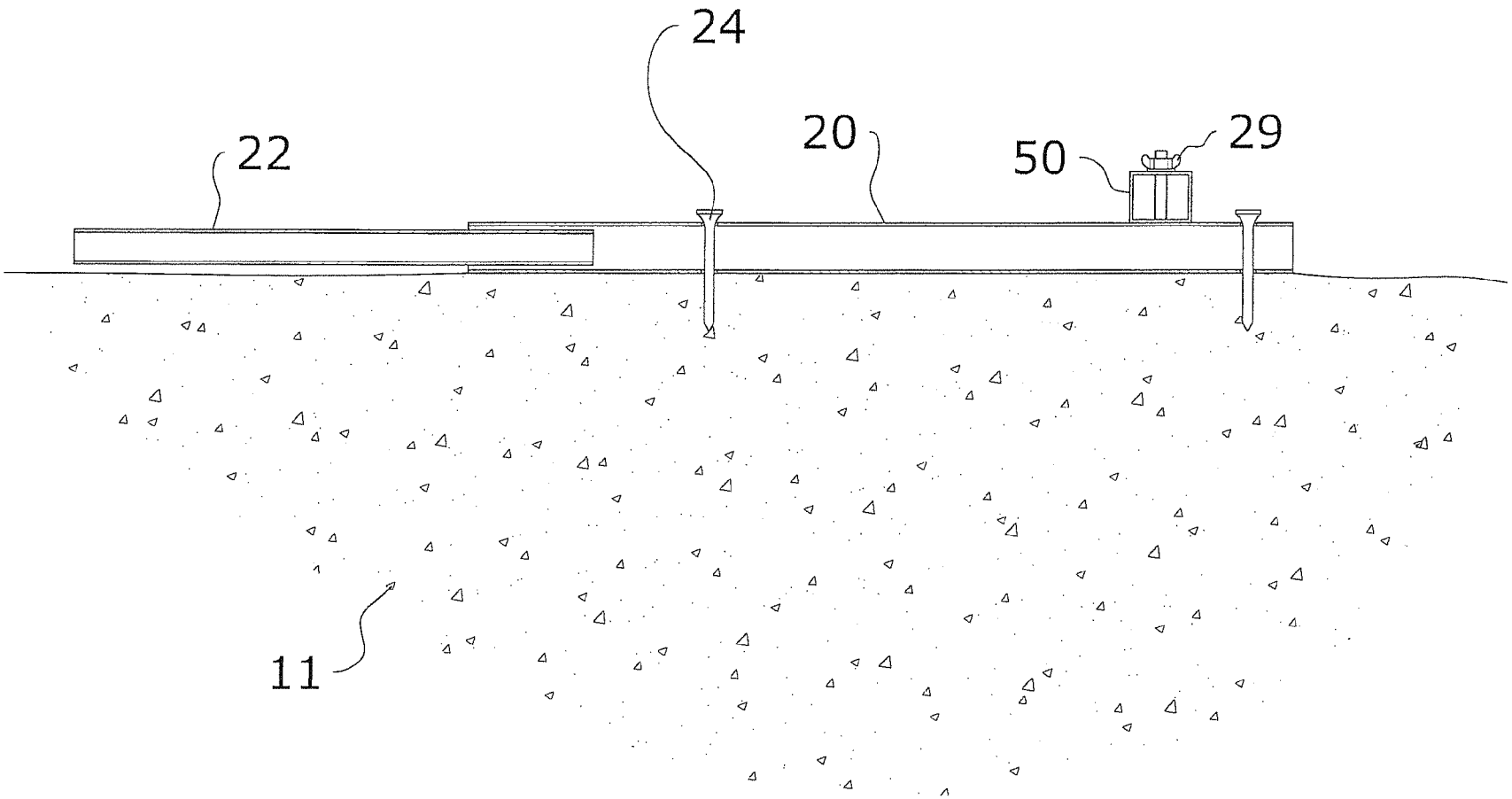
FIG. 10 is a sectional view of the present invention illustrating the securing members.
Figure 11:
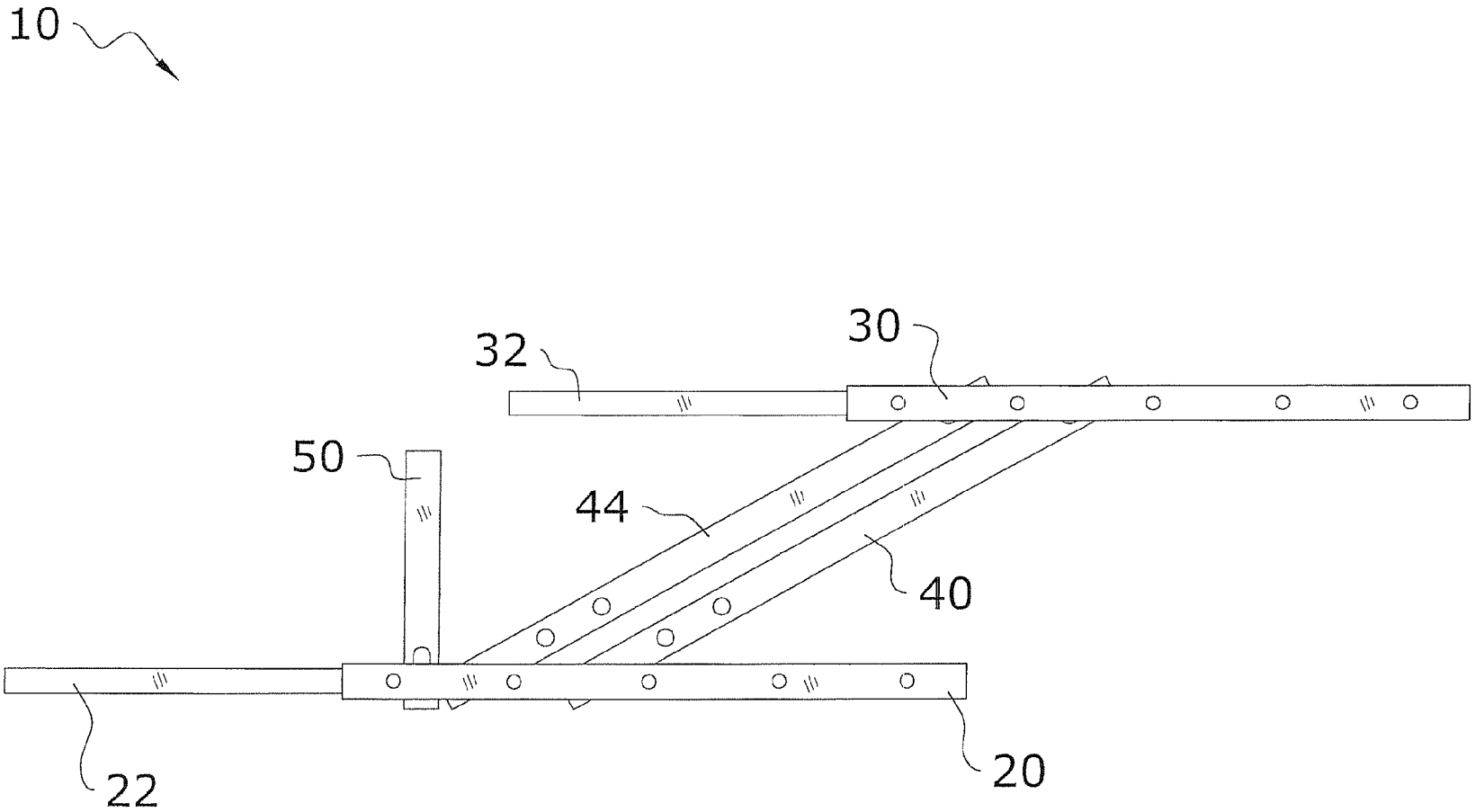
FIG. 11 is a bottom view of the present invention.

The first extension member 22 may also receive a plurality of first securing members 24 as illustrated in FIGS. 2 and 10. The second extension member 32 may also receive a plurality of second securing members 34. The first securing members 24 and the second securing members 34 extend through the apertures 26 and/or slots 27 of the first alignment member 20 and the second alignment member 30 respectively and into the ground 11. The first securing members 24 and the second securing members 34 serve to substantially anchor the present invention to the ground 11 when utilizing the present invention. The first securing members 24 and the second securing members 34 may be comprised of various configurations, such as but not limited to golf tees.

The present invention also preferably includes a third alignment member 50 extending from the first alignment member 20 as illustrated in FIGS. 1 through 4. The third alignment member 50 is preferably aligned with the club head 17 of the golf club during use of the present invention. The third alignment member 50 also preferably extends perpendicular to the first alignment member 20 as shown in FIGS. 1 through 4. The perpendicular orientation of the third alignment member 50 further helps the individual to maintain a perpendicular stance in relation to the line to the target 19. It is appreciated that the third alignment member 50 may also be attached to the second alignment member 30 rather than the first alignment member 20.

The third alignment member 50 may be comprised of various configurations. The third alignment member 50 is preferably comprised of an elongated configuration. The third alignment member 50 may also include a plurality of slots 27 and/or apertures 26 to selectively adjust upon the first alignment member 20 and/or second alignment member 30. The third alignment member 50 is further preferably pivotally attached via a fastener 29 to the first alignment member 20. It is appreciated however that the third alignment member 50 may be integrally formed with the first alignment member 20. It is also appreciated that the third alignment member 50 may include various anchoring mechanisms (i.e. spikes, golf tees, peg, etc.) to secure the third alignment in place upon the ground 11.

It is appreciated that utilizing apertures 26 is preferred to slots 27 with the alignment members 20, 30, 50, wherein apertures allow for an easier setup process of the present invention. It is further appreciated that utilizing round apertures 26 secures the alignment members 20, 30 in a parallel orientation and utilizing slots 27 allows for the alignment members 20, 30 to be configured in an open stance or closed stance as well as the parallel configuration.

C. Diagonal Members

The diagonal members 40, 44 extend between the first alignment member 20 and the second alignment member 30 as illustrated in FIGS. 1 through 9. The diagonal members 40, 44 are further preferably pivotally attached between the first alignment member 20 and the second alignment member 30, wherein the first alignment member 20 may move closer and/or farther apart from one another according to the preference of the individual utilizing the present invention via the diagonal members 40, 44. It is also appreciated that the diagonal members 40, 44 allow for easy folding of the present invention, wherein the present invention may be conveniently carried from to a golf practice range (i.e. driving range, etc.) or efficiently stored when not in use.

It is appreciated that the diagonal members 40, 44 may be oriented in various manners all which maintain a substantially oblique configuration with respect to the first alignment member 20 and the second alignment member 30 as illustrated in FIGS. 1 through 9. It is also appreciated that the present invention may include any number of diagonal members 40, 44. In the preferred embodiments, the present invention includes preferably includes 2 diagonal members 40, 44. The diagonal members 40, 44 are preferably attached to the first alignment member 20 and the second alignment member 30 via a plurality of fasteners 29; however it is appreciated that the diagonal members 40, 44 may be integrally formed with the first alignment member 20 and the second alignment member 30.

Utilizing a first diagonal member 40 and a second diagonal member 44 allows for the first alignment member 20 to maintain a parallel orientation with the second alignment member 30 during the folding and unfolding or adjusting of the distance between the first alignment member 20 and the second alignment member 30. The diagonal members 40, 44 may also include various slots 27 and/or apertures 26 to allow for adjustment upon the first alignment member 20 and the second alignment member 30 as illustrated in FIGS. 1 through 9. It is appreciated that utilizing apertures 26 is preferred to slots 27 with the diagonal members 40, 44, wherein apertures allow for an easier setup process of the present invention.

D. Cross Members

Figure 5:
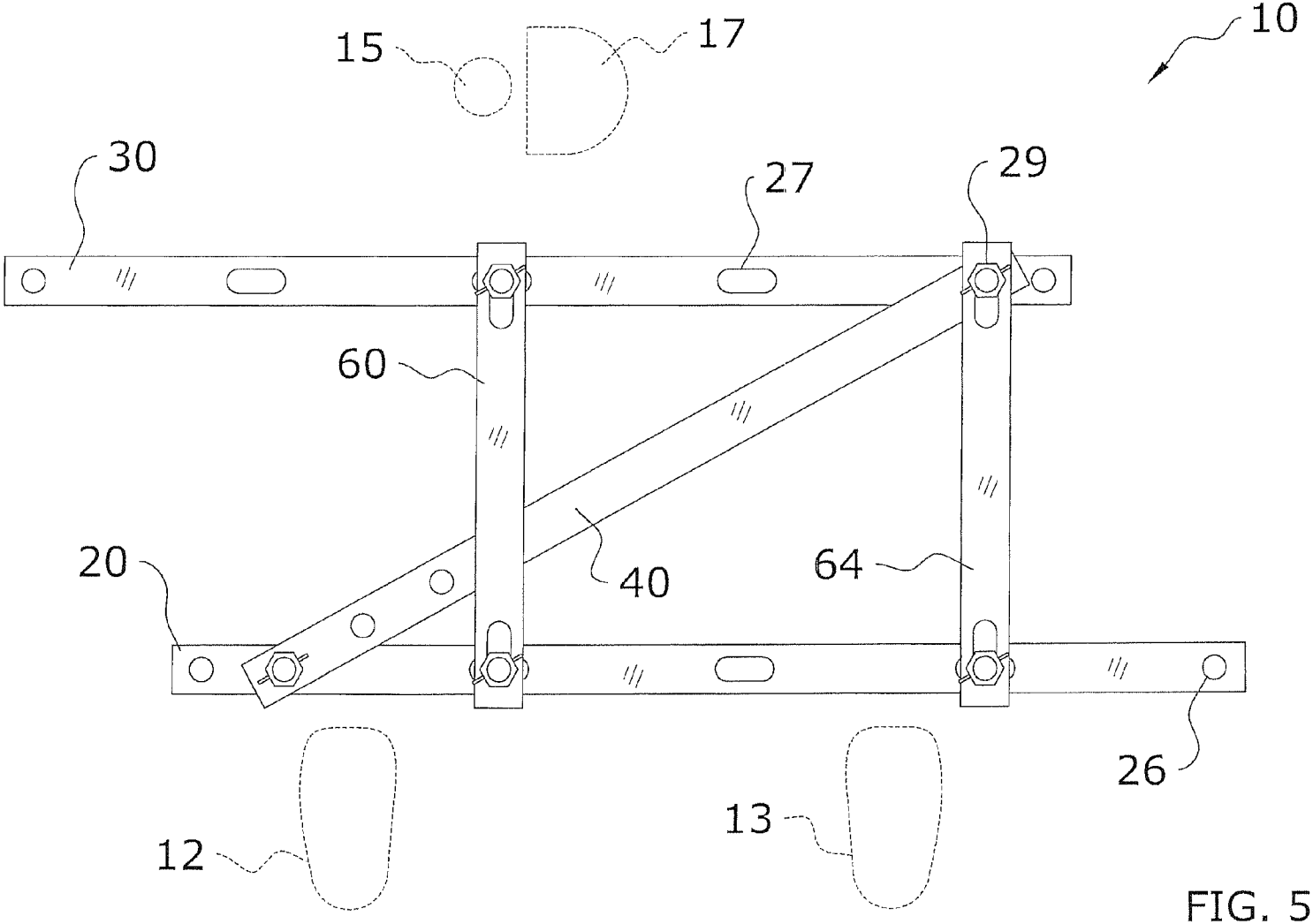
FIG. 5 is a top view of the present invention utilizing two cross members.
Figure 6:
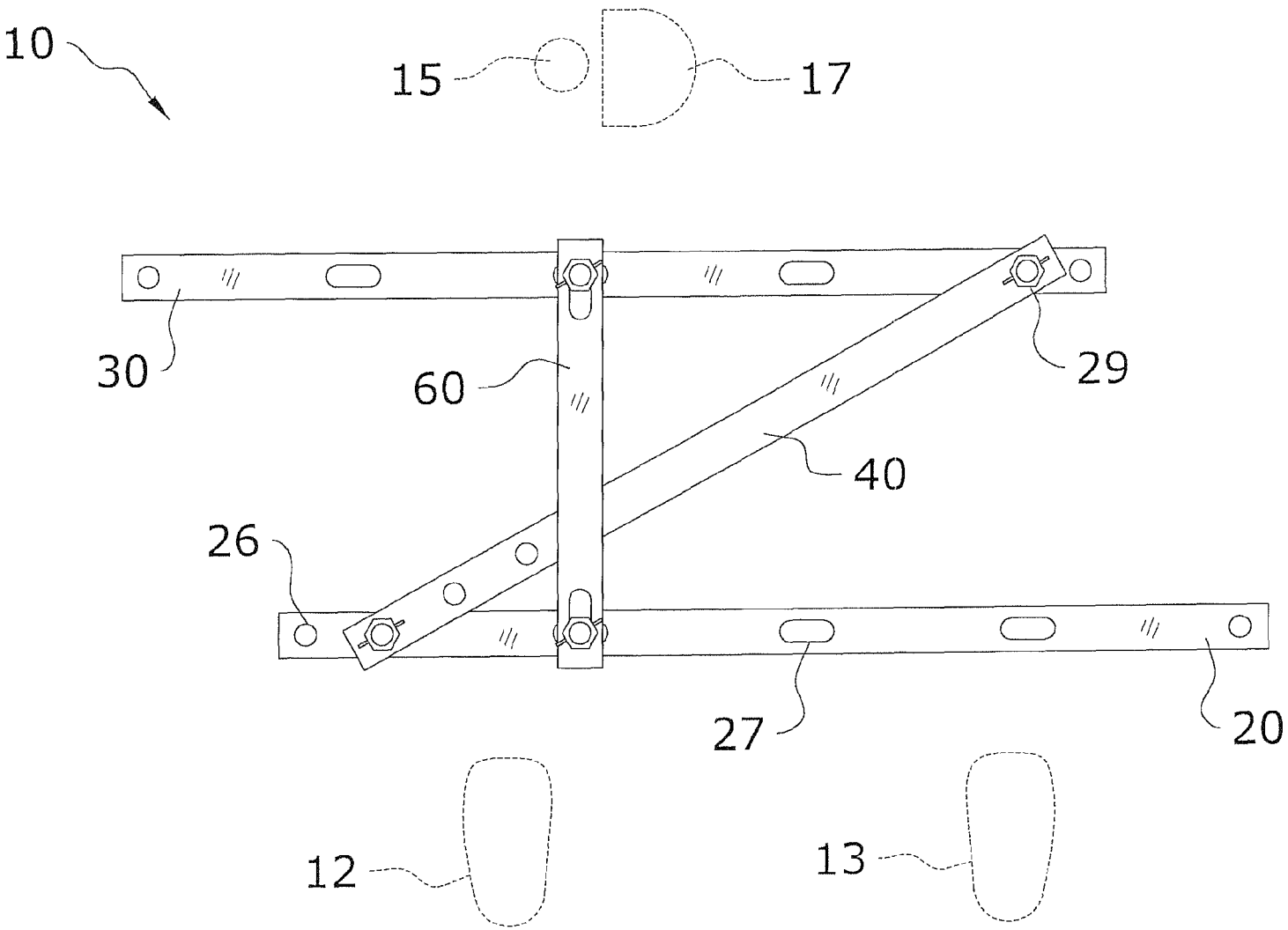
FIG. 6 is a top view of the present invention utilizing one cross member.
Figure 7:
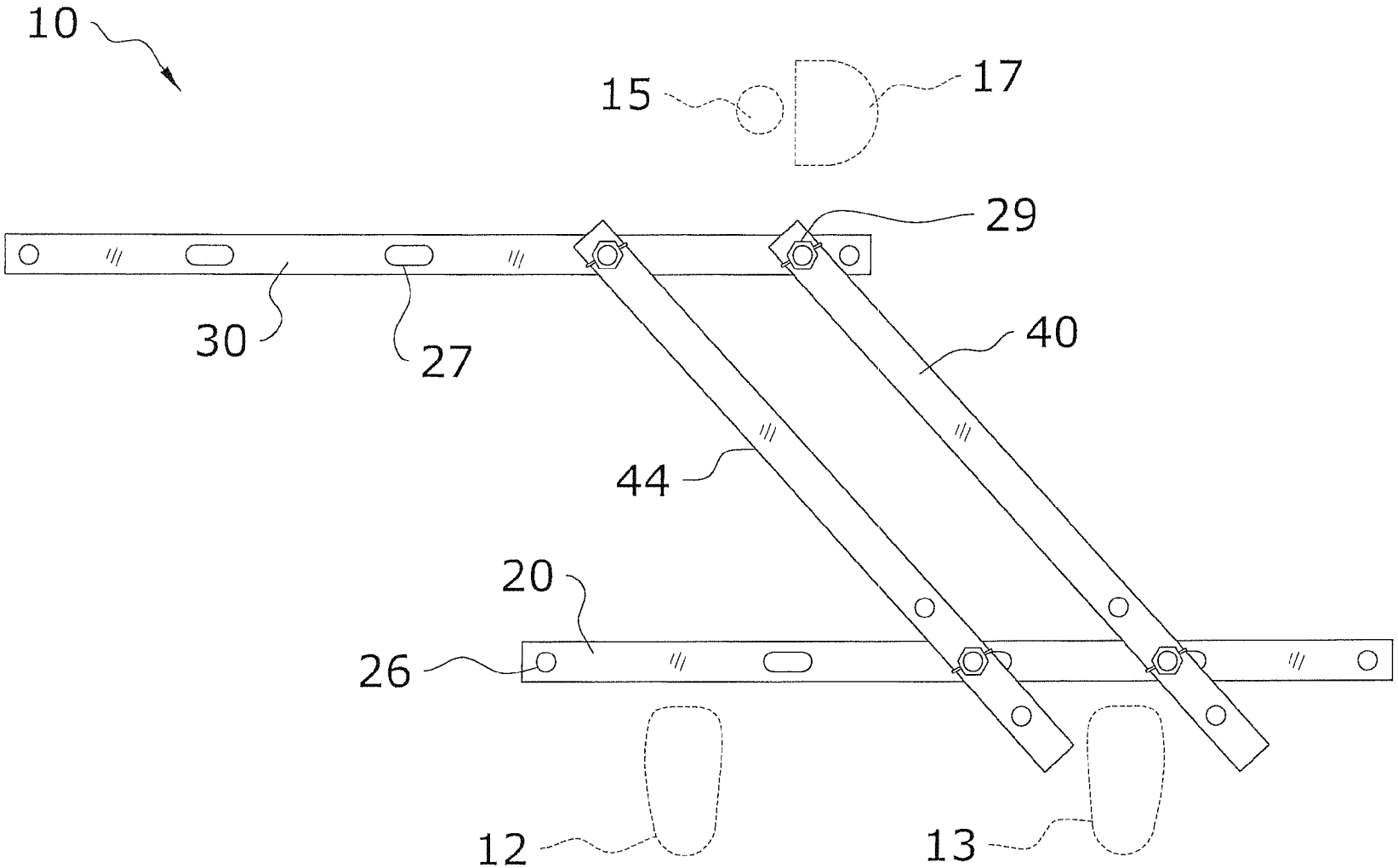
FIG. 7 is a top view of the present invention in an alternate orientation.

The present invention may also include one or more cross members 60, 64 to attach between the first alignment member 20 and the second alignment member 30 as illustrated in FIGS. 5 and 6. The cross members 60, 64 serve to stabilize the first alignment member 20 and the second alignment member 30 and also to further maintain the parallel orientation between the first alignment member 20 and the second alignment member 30. The cross members 60, 64 are preferably attached to the first alignment member 20 and the second alignment member 30 via a plurality of fasteners 29; however it is appreciated that the cross members 60, 64 may be integrally formed with the first alignment member 20 and the second alignment member 30.

The cross members 60, 64 are further preferably positioned in a perpendicular orientation with respect to the first alignment member 20 and the second alignment member 30. It is appreciated that the cross members 60, 64 may also include a plurality of slots 27 and/or apertures 26 to allow for adjustment upon the first alignment member 20 and the second alignment member 30.

It is also appreciated that one or more cross members 60, 64 may also function in a manner similar to the third alignment member 50 as described previously and illustrated in FIGS. 5 and 6. It is appreciated that utilizing apertures 26 is preferred to slots 27 with the cross members 60, 64, wherein apertures allow for an easier setup process of the present invention.

E. In Use

In use, the individual first unfolds and/or assembles the present invention according to the previous description and their personal preferences. The individual then positions the present invention on the ground 11 and between the individual and their golf ball 15. The first alignment member 20 and the second alignment member 30 are also preferably oriented substantially perpendicular between the individual and their golf ball 15.

The second alignment member 30 is now aligned with where the individual desires to hit the golf ball 15 (i.e. target 19). The first alignment member 20 is now adjusted to be substantially parallel with the second alignment member 30 as illustrated in FIGS. 1 through 7. It is appreciated that the first alignment member 20 may also be adjusted at a slight forward or rearward angle in relation to the second alignment member 30 if the individual desired to utilize a closed stance or open stance.

The third alignment member 50 is now oriented perpendicular with the first alignment member 20 and/or second alignment member 30. The individual positions their club head 17 on an outward side of the second alignment member 30 and in line with the third alignment member 50 as shown in FIG. 1. The golf ball 15 is positioned slightly forward of the club head 17 as illustrated in FIGS. 1 through 9. It is appreciated that the present invention may have to be slightly adjusted in a forward or rearward direction to ensure the club head 17 is positioned adjacent to the golf ball 15 if the golf ball 15 is already in play (i.e. any shot after the initial shot of each hole).

The individual now positions their feet 12, 13 on an outward side of the first alignment member 20, wherein their forward foot (i.e. left foot 12 for right handed golfers, right foot 13 for left handed golfers) is positioned substantially in line with the golf ball 15. The individual then may reposition their club head 17 in line with the third alignment member 50, concentrate and swing in a normal manner. It is appreciated that the extension members 22, 32 may also be extended during the process. To utilize the present invention for another shot, the above process is simply repeated.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A golfer alignment system, comprising:

a first alignment member comprised of an elongated configuration;

a second alignment member comprised of an elongated configuration;

at least one diagonal member attached between said first alignment member and said second alignment member, wherein said at least one diagonal member is attached in an oblique configuration with respect to said first alignment member and said second alignment member;

wherein said first alignment member includes a plurality of first openings to adjust a first end of said at least one diagonal member.

2. The golfer alignment system of claim 1, wherein said at least one diagonal member is pivotally attached to said first alignment member and said second alignment member.

3. The golfer alignment system of claim 1, wherein said first alignment member, said second alignment member and said at least one diagonal member comprise a Z-shaped configuration.

4. The golfer alignment system of claim 1, wherein said second alignment member includes a plurality of second openings to adjust a second end of said at least one diagonal member.

5. The golfer alignment system of claim 4, wherein said at least one diagonal member includes a plurality of third openings positioned adjacent said first end and said second end.

6. The golfer alignment system of claim 1, wherein said at least one diagonal member comprises a first diagonal member and a second diagonal member.

7. The golfer alignment system of claim 6, wherein said first diagonal member and said second diagonal member are parallel.

8. The golfer alignment system of claim 6, wherein said first diagonal member and said second diagonal member are each pivotally attached to said first alignment member and said second alignment member.

9. The golfer alignment system of claim 1, including a first extension member, wherein said first extension member slidably adjusts about said first alignment member, wherein said first extension member is parallel to said first alignment member.

10. The golfer alignment system of claim 9, including a second extension member, wherein said second extension member slidably adjusts about said second alignment member, wherein said second extension member is parallel to said second alignment member.

11. The golfer alignment system of claim 1, including a third alignment member extending between said first alignment member and said second alignment member, said third alignment member is attached to said first alignment member, and said third alignment member is perpendicular to said first alignment member.

12. The golfer alignment system of claim 1, wherein said first alignment member includes a plurality of first securing members to anchor said first alignment member to a ground surface, wherein said second alignment member includes a plurality of second securing members to anchor said second alignment member to said ground surface.

13. A golfer alignment system, comprising:

a first alignment member comprised of an elongated configuration;

a second alignment member comprised of an elongated configuration;

wherein said first alignment member is positioned oblique to said second alignment member;

at least one diagonal member attached between said first alignment member and said second alignment member, wherein said at least one diagonal member is attached in an oblique configuration with respect to said first alignment member and said second alignment member;

wherein said first alignment member includes a plurality of first openings to adjust a first end of said at least one diagonal member.

14. A golfer alignment system, comprising:

a pair of alignment members each comprised of an elongated structure;

at least one diagonal member attached between said pair of alignment members, said at least one diagonal member positioned in an oblique manner with respect to said pair of alignment members;

a plurality of adjustment openings, said plurality of adjustment openings located along at least one of said pair of alignment members and/or said at least one diagonal member for adjustment of a position of said at least one of said pair of alignment members and/or said at least one diagonal member.

15. The golfer alignment system of claim 14, wherein said pair of alignment members are positioned oblique to each other.

16. The golfer alignment system of claim 14, wherein said plurality of adjustment openings are along said at least one of said pair of alignment members.

17. The golfer alignment system of claim 14, wherein said plurality of adjustment openings are along said pair of alignment members.

18. The golfer alignment system of claim 14, wherein said plurality of adjustment openings are along said at least one diagonal member.

19. The golfer alignment system of claim 14, wherein said plurality of adjustment openings are along said at least one of said pair of alignment members and said at least one diagonal member.

* * * * *